US011311935B2

(12) United States Patent
Sheng et al.

(10) Patent No.: US 11,311,935 B2
(45) Date of Patent: Apr. 26, 2022

(54) THERMAL TREATMENT METHOD FOR METAL INJECTION MOLDING PARTS, A METAL INJECTION MOLDING PART AND AN AIRCRAFT ENGINE

(71) Applicant: Rolls-Royce Deutschland Ltd & Co KG, Blankenfelde-Mahlow (DE)

(72) Inventors: Naicheng Sheng, Erlangen (DE); Andreas Meyer, Veitsbronn (DE); Katharina Horke, Berlin (DE); Robert Singer, Erlangen (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 393 days.

(21) Appl. No.: 16/354,856

(22) Filed: Mar. 15, 2019

(65) Prior Publication Data

US 2019/0283138 A1 Sep. 19, 2019

(30) Foreign Application Priority Data

Mar. 16, 2018 (DE) ..... 10 2018 204 088.5

(51) Int. Cl.

| | |
|---|---|
| ***B22F 5/00*** | (2006.01) |
| ***B22F 5/04*** | (2006.01) |
| ***B22F 3/10*** | (2006.01) |
| ***C22C 1/04*** | (2006.01) |
| ***C22C 19/05*** | (2006.01) |

(Continued)

(52) U.S. Cl.

CPC ..... *B22F 5/009* (2013.01); *B22F 3/1017* (2013.01); *B22F 3/225* (2013.01); *B22F 3/24* (2013.01); *B22F 5/04* (2013.01); *C22C 1/0433* (2013.01); *C22C 19/057* (2013.01); *C22F 1/10* (2013.01); *F01D 5/286* (2013.01); *B22F 2003/248* (2013.01); *B22F 2301/15* (2013.01); *B22F 2303/01* (2013.01); *C22C 32/0047* (2013.01); *F05D 2220/323* (2013.01); *F05D 2230/22* (2013.01); *F05D 2230/40* (2013.01)

(58) Field of Classification Search

None

See application file for complete search history.

(56) References Cited

U.S. PATENT DOCUMENTS 5,035,958 A 7/1991 Jackson et al.
5,989,493 A 11/1999 La Salle et al.

(Continued)

FOREIGN PATENT DOCUMENTS

CA 2588626 A1 11/2008

OTHER PUBLICATIONS

European Search Report dated Jul. 29, 2019 for counterpart European Patent Application No. 19162569.8.

(Continued)

*Primary Examiner* — Anthony M Liang

(74) *Attorney, Agent, or Firm* — Shuttleworth & Ingersoll, PLC; Timothy J. Klima

(57) ABSTRACT

A method for the thermal treatment of a component, in particular a metal powder injection molded component (MIM component) including a nickel base alloy, wherein, after sintering, in particular immediately after sintering, in the injection molding process, the component is exposed for a predetermined holding time to at least one treatment temperature below the sintering temperature. A component, in particular an MIM component, and to an aircraft engine.

18 Claims, 3 Drawing Sheets

(51) Int. Cl.

| | |
|---|---|
| ***F01D 5/28*** | (2006.01) |
| ***B22F 3/22*** | (2006.01) |
| ***C22F 1/10*** | (2006.01) |
| ***B22F 3/24*** | (2006.01) |
| *C22C 32/00* | (2006.01) |

(56) References Cited

U.S. PATENT DOCUMENTS

| | | | |
|---|---|---|---|
| 2012/0073303 | A1 | 3/2012 | McCarren et al. |
| 2016/0245099 | A1 | 8/2016 | Dawson et al. |

OTHER PUBLICATIONS

A. Meyer et al., "Metal Injection Moulding of Nickel-Based Superalloy CM247LC", Powder Metallurgy, Bd. 59, Nr. 1, May 17, 2016 ISSN: 1743-2901, DOI: 10.1080/00325899.2016.1142058.

German Search Report dated Nov. 30, 2018 for counterpart German Patent Application No. 10 2018 204 088.5.

Meyer, Andreas; Metal Injection Molding of Nickel_Base Superalloy CM247LC: Influence of Heat Treatment on the Microstructure and Mechanical Properties; International Conference on Powder Metallurgy Particulate Materials; Jun. 12-16, 2017.

Oezguen, et al.; Injection molding of nickel based 625 superalloy: Sintering, heat treatment, microstructure and mechanical proeprties; Journal of Alloys and Compounds 546 (3013) 192-207.

A. Meyer et al., "Metal Injection Moulding of Nickel-Based Superalloy CM247LC", Powder Metallurgy, Bd. 59, Nr. 1, May 17, 2016, pp. 51-56.

THERMAL TREATMENT METHOD FOR METAL INJECTION MOLDING PARTS, A METAL INJECTION MOLDING PART AND AN AIRCRAFT ENGINE

This application claims priority to German Patent Application DE102018204088.5 filed Mar. 16, 2018, the entirety of which is incorporated by reference herein.

DESCRIPTION

The present invention relates to a method for the thermal treatment of components, to a component and to an aircraft engine having the features as disclosed herein.

In machines subject to high thermal stresses, it is necessary to use components which retain their mechanical properties, in particular, even at high temperatures. There is a known practice, for example, of producing components for aircraft engines by metal powder injection molding (MIM) or other powder binder methods, e.g. also additive manufacturing methods with powder binder starting materials (e.g. fused filament fabrication, binder jetting). In this process, nickel base materials such as CM247LC are used as a "superalloy", for example (Meyer et al., "Metal Injection Molding of Nickel-Base Superalloy CM247LC: Influence of Heat Treatment on Microstructure and Mechanical Properties", in Proceedings of International Conference on Powder Metallurgy & Particulate Materials (POWDERMET 2017), Jun. 13-16, 2017); Meyer et al., "Metal Injection molding of nickel base superalloy CM247LC", Powder Metallurgy 59, 2016, 51-56). Metal powder injection molded components are referred to below for short as MIM components.

Typically, the production of binder-based components, in particular MIM components, comprises four steps: the production of the "feedstock" from metal powder and binders, the injection molding process, binder removal and sintering.

Components of complex shape, such as blades in compressors or turbines of aircraft engines, can thereby be produced in a cost effective way, wherein the components may even already have the desired final contours at the end of the production process. One possible use for such blades is, in particular, also in geared fan aircraft engines, in which there are thermally highly stressed regions.

Here, the grain size which can be achieved in the components after sintering is relatively small owing to the fine metal powder. Even relatively prolonged thermal treatment (annealing) at as high as possible temperatures below the melting point does not lead to a significant growth in grain size (e.g. it is only possible to achieve sizes of between 20 and 50 μm). As a result, the creep limit of the MIM component that can be achieved at high temperatures is limited since slippage can arise at the grain boundaries.

However, it is often desirable for the grain size of the fully sintered components, in particular the MIM components, to be as large as possible.

The method having features as disclosed herein addresses this subject.

Accordingly, the component, in particular an MIM component, comprising a nickel base alloy is subjected to a thermal treatment after sintering, for example generally the final step in the MIM process. This treatment is distinguished by the fact that at least one treatment temperature below the sintering temperature is chosen with a predetermined holding time. This means that there can also be more than one treatment temperature below the sintering temperature, which is applied in intervals, for example. The predetermined holding time follows for example immediately after the sintering, i.e. there is for example no intermediate cooling before the holding phase.

Thus, surprisingly, there is significantly greater grain growth in the sintered component than was hitherto known.

In one embodiment of the method, the difference between the sintering temperature and the at least one treatment temperature is less than 60° C., in particular less than 50° C., very particularly in the range of from 20 to 40° C.

In another embodiment of the method, the holding time of the treatment temperature is between 0.5 hours and 50 hours, in particular between 5 and 35 hours.

In one embodiment, the component is held for 10 to 20 hours, in particular 15 hours, at 1260° C., for 2 to 6 hours, in particular 4 hours, at 1080° C. and for 15 to 25 hours, in particular 20 hours, at 870° C. after the sintering. This shows that the holding can also take place at different temperature levels. This temperature control profile may follow immediately after the sintering.

In another embodiment of the method, a CM247LC alloy or a modified CM247LC alloy is used as the nickel base alloy. In this case, the modified CM247LC alloy can contain proportions of elements within the following limits, for example (minimum and maximum proportion in % by weight):

| | | Alloy (% by weight) | | | | | | | | | | | |
|---|---|---|---|---|---|---|---|---|---|---|---|---|---|
| | | Ni | Cr | Co | Mo | Al | Ti | Ta | W | C | B | Zr | Hf |
| Mod. CM247LC alloy | Min | Bal. | C7.5 | 9.0 | 0.4 | 5.4 | 0.0 | 0.0 | 9.3 | 0 | 0 | 0 | 0 |
| | Max | Bal. | 8.5 | 9.5 | 0.6 | 5.7 | 0.6 | 3.1 | 9.7 | 0.07 | 0.01 | 0.007 | 1.4 |

The modification of this alloy relative to the CM247LC alloy consists especially in the modified, generally reduced, proportions of Ti, Ta, W, C, B, Zr and Hf. Thus, the modified CM247LC alloy can contain a total of more than 1.5% by weight of carbide formers C, Hf, Ti, Ta, B, Nb and/or Zr, i.e. the modified CM247LC alloy can also contain Nb in one embodiment. As an alternative or in addition, one embodiment can contain boride formers W, Co and/or Cr.

In another method, the modified CM247LC alloy has a carbon content of less than 0.05% by weight, in particular less than 0.04% by weight, in particular of 0.03% by weight, and a hafnium content of less than 1.4% by weight, in particular a hafnium content of less than 1% by weight, in particular of less than 0.5% by weight, in particular of 0.4% by weight.

As an alternative, the modified CM247LC alloy can have a carbon content of less than 0.06% by weight, in particular of 0.05% by weight, and a hafnium content of less than 1.4% by weight, in particular a hafnium content of less than 1% by weight, in particular of less than 0.5% by weight, in particular of 0.0% by weight.

In another embodiment relating to a CM247LC alloy or a modified CM247LC alloy, the at least one treatment temperature is between 1240 and 1290° C., in particular between 1250 and 1285° C., in particular 1260° C.

The object is also achieved by a component, in particular an MIM component, having the features as disclosed herein, which can be produced in particular by a method as disclosed herein. The component has in this case a proportion of the surface area with an average grain size of more than 200 μm, in particular of more than 400 μm and very particularly of more than 500 μm, of at least 20%. The average grain size is in this case to be determined in accordance with the intercept method ASTM E112-13. In this case, an average grain size of 200 μm corresponds to an ASTM grain size of about 1.5. Consequently, the ASTM grain size would be at least 1.5 or smaller. It is also possible in one embodiment that there is a proportion of the surface area with an average grain size of less than 200 μm, in particular less than 100 μm and very particularly of less than 80 μm, of a maximum of up to 80%.

The component, in particular the MIM component, can be part of an engine or of a turbocharger, in particular a blade of a compressor, a compressor component, in particular a holding plate, a journal, a lever, a nut, a washer (e.g. in a burner device), a damper or a seal, for example.

In this case, the blade can be designed as a guide vane or as a rotor blade.

This object is also achieved by an aircraft engine having features as disclosed herein.

Exemplary embodiments are described in conjunction with figures, of which

One possible use of embodiments of MIM components is described below with reference to a geared fan engine.

Figure 1:
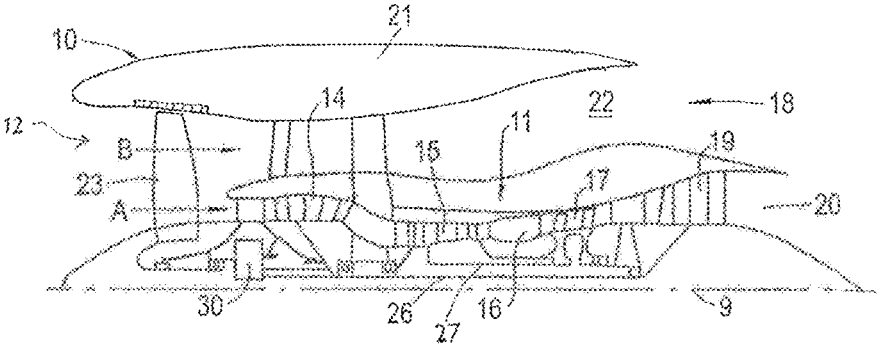
FIG. 1 shows a lateral sectional view through of a geared fan engine.

In this context, FIG. 1 describes an aircraft engine 10 having a principal rotational axis 9. The aircraft engine 10 has an air intake 12 and a fan 23, which produces two airflows: an airflow A through a core engine 11 and a bypass airflow B.

When viewed in the axial direction of flow, the core engine 11 comprises a low pressure compressor 14, a high pressure compressor 15, a burner device 16, a high pressure turbine 17, a low pressure turbine 19 and a core engine outlet nozzle 20. A nacelle 21 surrounds the aircraft engine 10 and defines the bypass duct 22 (also referred to as a secondary flow duct) and a bypass duct outlet nozzle 18. The bypass airflow B flows through the bypass duct 22. The fan is driven by the low pressure turbine 19 via the shaft 26 and a planetary gearbox 30.

In operation, the airflow A in the core engine 11 is accelerated and compressed by the low pressure compressor 14, wherein it is guided into the high pressure compressor 15, in which further compression takes place. The compressed air emerging from the high pressure compressor 15 is guided into the burner device 16, in which it is mixed with fuel and burnt.

The hot combustion gases formed are passed through the high pressure turbine 17 and the low pressure turbine 19, which are driven by the combustion gases. The MIM components can be used in the low pressure compressor 14, the high pressure compressor 15, the high pressure turbine 17 and/or the low pressure turbine 19, for example. Here, the highest temperatures occur at the outlet of the burner device 16 and at the inlet of the high pressure turbine 17.

The combustion gases emerge through the core outlet nozzle 20 and provide a proportion of the total thrust. The high pressure turbine 18 drives the high pressure compressor 15 via an appropriate interconnecting shaft 27. The fan 23 generally provides the greatest proportion of the propulsive thrust. Here, the planetary gearbox 30 is designed as a reduction gearbox in order to reduce the rotational speed of the fan 23 relative to the driving turbine.

Figure 2:
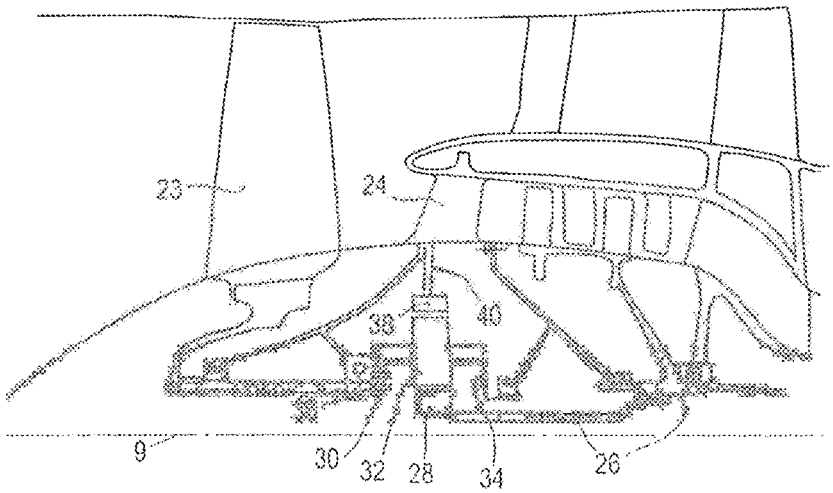
FIG. 2 shows an enlarged view of a lateral sectional view through the front part of the engine shown in FIG. 1.

An exemplary arrangement for a geared fan arrangement of an aircraft gearbox is illustrated in FIG. 2.

The low pressure turbine 19 (see FIG. 1) drives the shaft 26, which is coupled to a sun gear 28 of the planetary gearbox 30. Radially outwardly of the sun gear 28 and in mesh there is a multiplicity of planet gears 32 coupled together by a planet carrier 34. The planet carrier 34 forces the planet gears 32 to precess around the sun gear 28 in synchronicity, whilst enabling each planet gear 32 to rotate about its own axis. The planet carrier 34 is coupled to the fan 23 by links 36 in order to bring about the rotation of said fan about the rotational axis 9. Connected radially outwardly of the planet gears 32 and in mesh therewith there is a ring gear or annulus 38, which is connected, via links 40, to a stationary supporting structure 24. This design represents an epicyclic planetary gearbox 30.

It should be noted that the expressions "low pressure turbine" and "low pressure compressor", as used here, can be understood to mean that they signify the lowest-pressure turbine stages and the lowest-pressure compressor stages (i.e. without the fan 23) and/or the turbine and compressor stages which are connected together by the interconnecting shaft 26 with the lowest rotational speed in the engine 10 (i.e. without the gearbox output shaft that drives the fan 23). Alternatively, a "low pressure turbine" and a "low pressure compressor" to which reference is made here can also be understood to mean an "intermediate pressure turbine" and an "intermediate pressure compressor". When such alternative nomenclature is used, the fan 23 can be referred to as a first or a lowest compressor stage.

The planetary gearbox 30 which is illustrated by way of example in FIG. 2 is an epicyclic planetary gearbox since the planet carrier 34 is connected rotatably, i.e. in particular drivably, to the fan 23 by a shaft. In contrast, the hollow shaft 38 is of fixed design.

However, any other suitable type of planetary gearbox 30 can also be used.

As another example, the planetary gearbox 30 may have a star arrangement, in which the planet carrier 34 is held fixed and the annulus 38 can rotate. In such an arrangement, the fan 23 is driven by the annulus 38. As another alternative example, the gearbox 30 may be a differential, in which both the annulus 38 and the planet carrier 34 can rotate.

It is clear that the arrangement shown in FIG. 2 is by way of example only and that various alternatives are also within the scope of protection of the present disclosure. Purely by way of example, any suitable arrangement may be used to arrange the planetary gearbox 30 in the engine 10 and/or to connect the planetary gearbox 30 to the engine 10. As another example, the links (such as the links 36, 40 in the embodiment shown in FIG. 2) between the planetary gearbox 30 and other parts of the engine 10 (such as the core engine shaft 26, the output shaft and the stationary supporting structure 24) may have any desired degree of stiffness or flexibility.

As another example, any suitable arrangement of the bearings between the rotating and stationary parts of the engine 10 (e.g. between the input and output shafts of the planetary gearbox 30 and the fixed structures, e.g. the gearbox casing) may be used and there is no restriction to the exemplary arrangement in FIG. 2. If the planetary gearbox 30 has a star arrangement, for example, a person skilled in the art would understand that the arrangement of output and support links and bearing locations would typically be different to that shown in FIG. 2.

Accordingly, the present disclosure extends to an aircraft engine 10 having any desired arrangement of gearbox forms (e.g. star arrangement or epicyclic planetary arrangements), supporting structures, input and output shaft arrangement and bearing points.

Optionally, the planetary gearbox 30 may drive additional and/or alternative components (e.g. the intermediate pressure compressor and/or a booster compressor).

Other aircraft engines 10 to which the present disclosure may be applied may have alternative configurations. Such aircraft engines 10 may have a different number of compressors and/or turbines and/or a different number of interconnecting shafts, for example. As a further example, the engine 10 shown in FIG. 1 has a split-flow nozzle 20, meaning that the flow through the bypass duct 22 has its own nozzle that is separate to and arranged radially outside the core engine outlet nozzle 20. This should not be taken as restrictive, and any aspect of the present disclosure may also be applied to engines 10 in which the flow through the bypass duct 22 and the flow through the core engine 11 are mixed or combined (before or upstream) by a single nozzle. This is referred to as a mixed flow nozzle. One or both nozzles (irrespective of whether there is mixed or partial flow) may have a fixed or variable cross section. Whereas the example described here refers to a turbofan engine, the disclosure may be applied to any type of aircraft turbine, for example, including, for example, an engine 10 which has an open rotor (in which the fan stage 23 is not surrounded by a housing) or a turboprop engine.

The geometry of the aircraft engine 10 and of the components thereof is defined by a conventional axis system, which comprises an axial direction (which is aligned with the rotational axis 9), a radial direction (in the bottom-to-top direction in FIG. 1) and a circumferential direction (perpendicular in the view in FIG. 1). The axial, radial and circumferential directions are mutually perpendicular.

It should be emphasized that MIM components can also be used in other machines, e.g. turbo compressors in motor vehicles or stationary gas turbines.

The production of MIM components is described below with reference to embodiment examples. In principle, the statements made here also apply to other methods with powder-binder systems (for example binder jetting, fused filament fabrication (FFF), fused deposition modeling (FDM)), which are used for example in additive manufacturing methods.

In one embodiment example of a method for the thermal treatment of a metal powder molded component (MIM component) comprising a nickel base alloy, after sintering, the MIM component is exposed for a predetermined holding time, e.g. more than 0.5 h, to a treatment temperature below the sintering temperature of the metal alloy. In principle, the holding time can also be less than 0.5 h. The treatment temperature does not have to be constant during the holding time. The treatment temperature can be varied in stages or continuously below the sintering temperature.

The sintering temperature for CM247LC (typical composition (minimum and maximum values for the respective elements; Bal: difference with respect to 100%) in Table 1) is 1305° C. in one embodiment of the method, for example, and therefore treatment temperatures in the range of from 1245° C. to 1285° C. can be used. In particular, the holding time can be between 0.5 and 50 hours, in particular between 5 and 35 hours. It is observed that the temperature indications should be understood, in particular, as averaged values.

This makes it possible to achieve significantly larger grain sizes after sintering than was known in the prior art (about two orders of magnitude larger). This may be connected with secondary recrystallization.

One possible embodiment of an MIM alloy, in which the proportions of Ti, Ta, C, B, Zr and Hf are reduced as compared with the known CM247LC alloy (modified CM247LC alloy), is likewise given in Table 1 as "Mod. CM247LC alloy" (minimum and maximum values for the respective elements; Bal: difference with respect to 100%). Said reduction in the proportions of the elements contributes to facilitating the movement of the grain boundaries, which must overcome the opposing forces arising from carbides, borides or grain boundary separation (also grain boundary segregation).

TABLE 1

| | | Alloy (% by weight) | | | | | | | | | | | |
|---|---|---|---|---|---|---|---|---|---|---|---|---|---|
| | | Ni | Cr | Co | Mo | Al | Ti | Ta | W | C | B | Zr | Hf |
| CM247LC | Min | Bal. | 7.5 | 9.0 | 0.4 | 5.4 | 0.6 | 3.1 | 9.3 | 0.07 | 0.01 | 0.007 | 1.4 |
| | Max | Bal. | 8.5 | 9.5 | 0.6 | 5.7 | 0.9 | 3.3 | 9.7 | 0.09 | 0.02 | 0.015 | 1.6 |
| Mod. | Min | Bal. | 7.5 | 9.0 | 0.4 | 5.4 | 0.0 | 0.0 | 9.3 | 0 | 0 | 0 | 0 |
| CM247LC alloy | Max | Bal. | 8.5 | 9.5 | 0.6 | 5.7 | 0.6 | 3.1 | 9.7 | 0.07 | 0.01 | 0.007 | 1.4 |

Results obtained with two embodiments (alloy 1, alloy 2) of a modified CM247LC alloy are shown below. The compositions of the two embodiments are shown in Table 2.

TABLE 2

| | Alloy (% by weight) | | | | | | | | | | | |
|---|---|---|---|---|---|---|---|---|---|---|---|---|
| | Ni | Cr | Co | Mo | Al | Ti | Ta | W | C | B | Zr | Hf |
| Alloy 1 | Bal. | 8.0 | 9.2 | 0.5 | 5.3 | 0.6 | 3.2-3.4 | 9.2-9.5 | 0.03 | 0.013 | 0.015 | 0.4 |
| Alloy 2 | Bal. | 8.3 | 9.2 | 0.5 | 5.7 | 0.7 | 3.0 | 9.7 | 0.05 | 0.014 | 0.017 | 0 |

Modified CM247LC alloy 1 has a carbon content of less than 0.05% by weight, namely of 0.03% by weight, and a hafnium content of less than 1% by weight, namely of 0.4% by weight.

Modified CM247LC alloy 2 has a carbon content of less than 0.06% by weight, namely of 0.05% by weight, and a hafnium content of less than 1% by weight, namely of 0.0% by weight.

Figure 3:
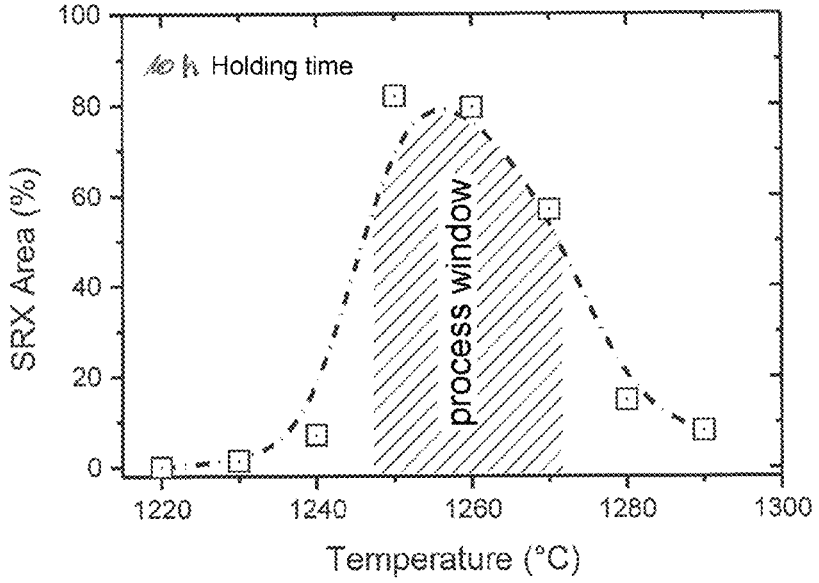
FIG. 3 shows an illustration of a process window for one embodiment of the method for the thermal treatment of an MIM component.

The dependence of the recrystallized area (expressed as SRX percentage area) on the treatment temperature at a constant holding time of 10 hours in each case is shown by way of example for alloy 1 in FIG. 3. Here, the SRX percentage areas (SRX: region in which grains are coarsened by secondary recrystallization) are defined as the ratio of the recrystallized area, determined in the sintered sample after the thermal treatment of the sintered sample, to the total area of the sintered sample (i.e. before the thermal treatment). Here, the sintering temperature is 1305° C.

There is a pronounced and surprising maximum of the recrystallized region, which is a measure of the grain size, especially between holding temperatures of 1240 and 1290° C., especially 1250 and 1285° C. The maximum grain size is achieved at about 1260° C.

Outside this temperature range, the grain size is significantly smaller. For alloy 1, a good process window (hatched region in FIG. 3) is a holding duration of 10 hours at treatment temperatures of between 1250° C. and 1270° C.

Thus, a temporary lowering of the temperature of the sintered MIM component to below the sintering temperature for a certain time leads to significant grain enlargement.

Figure 4:
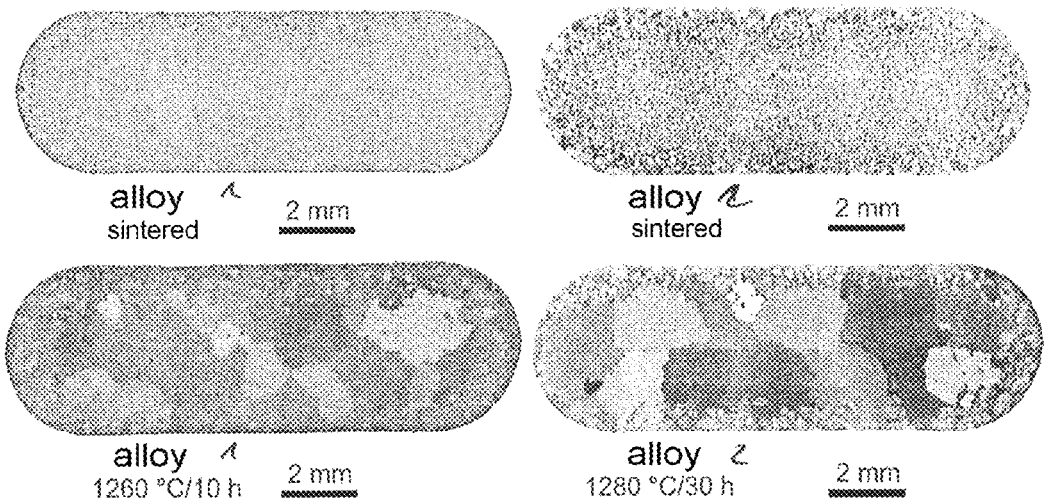
FIG. 4 shows an illustration of enlarged grain sizes obtainable by means of one embodiment of the method for the thermal treatment of an MIM component.

The grain enlargement on the basis of embodiments of the thermal treatment is clearly visible from micrographs in FIG. 4. The microstructure of an MIM component comprising alloy 1 (on the left) and comprising alloy 2 (on the right) after sintering is shown in the upper row in each case. The grains are small and, at the selected magnification, are in part hardly visible.

The grain size growth which can be achieved when applying an embodiment of the method for thermal treatment is shown in the lower row.

At the bottom left, there is a micrograph of alloy 1, which is obtained after a holding time of 10 hours and a holding temperature of 1260° C., i.e. 45° C. below the sintering temperature of 1305° C.

At the bottom right, there is a micrograph of alloy 2, which is obtained after a holding time of 30 hours and a holding temperature of 1280° C., i.e. 25° C. below the sintering temperature of 1305° C.

In both cases, the grain sizes after the thermal treatment are in a range above 500 mm, wherein all the micrographs in FIG. 4 have the same magnification.

More precise inspection of the thermally treated samples in FIG. 4 shows that there is a distribution of grain sizes in the samples. The grain size in the surface regions (i.e. at the edge of the samples in FIG. 4) is smaller than in the respective central region. This distribution has a technical advantage since large grains in the central region ensure high creep resistance and small grain sizes at the edge are advantageous for high-temperature corrosion resistance. The granularity of the edge region after thermal treatment corresponds approximately to the granularity of the edge region after sintering.

Measurements of mechanical properties which were obtained after heat treatment with the grain coarsening effect illustrated in FIG. 4 are shown below.

The top part of Table 3 indicates the time until fracture, the relative elongation and the minimum creep rate of the component after sintering.

The bottom part of Table 3 indicates the time until fracture, the elongation at break and the minimum creep rate of the component after the downstream thermal treatment.

TABLE 3

| | Test conditions | Time until fracture (h) | Elongation (%) | Minimum creep rate (%/h*$10^{-3}$) |
|---|---|---|---|---|
| After sintering | 700° C./550 MPa | 56.04 | 0.89 | 9.1 |
| | 800° C./300 MPa | 193.7 | 4.32 | 14.3 |
| | 800° C./250 MPa | 436.89 | 5.25 | 6.9 |
| | 900° C./150 MPa | 71.02 | 11.49 | 49.4 |
| | 900° C./125 MPa | 134.74 | 15.45 | 23.5 |
| With thermal treatment | 700° C./550 MPa | 59.43 | 0.47 | 1.4 |
| | 800° C./300 MPa | 187.76 | 0.46 | 0.6 |
| 1260° C./15 h | 800° C./250 MPa | 1218.38 | 0.43 | 0.1 |
| 1080° C./4 h | 900° C./150 MPa | 669.85 | 0.61 | 0.6 |
| 870° C./20 h | | | | |

Here, the thermal treatment was performed in 3 steps: annealing at 1260° C. for 15 hours, during which the observed considerable grain growth or secondary recrystallization occurs and two-stage holding (1080° C. (for 4 hours) and 870° C. (for 20 hours)).

Figure 5:
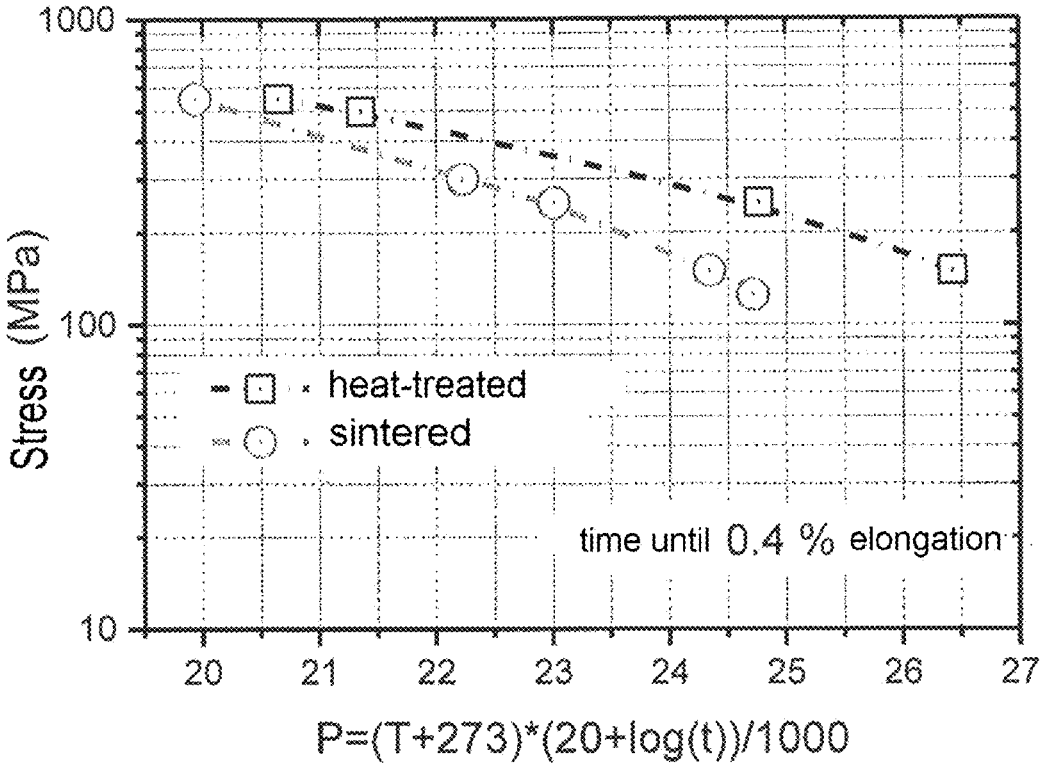
FIG. 5 shows an illustration of the creep resistance (Larson-Miller diagram) of MIM components.

A "Larson-Miller diagram" is shown in FIG. 5. In this case, the mechanical stress of the alloy 1 described above can be plotted on a loglog scale against the Larson-Miller parameter P, i.e. creep tests were carried out at different temperatures.

Owing to the low ductility of the heated alloy component, the data are plotted against time only up to the 0.4% elongation curve. The heat treatment leads to grain coarsening and hence to a decrease in the minimum creep rate or an increase in the creep resistance and creep rupture strength but also to a simultaneous decrease in ductility.

From FIG. 5, it can be seen that the creep rate due to the heat treatment (measurement points in the form of squares) of the MIM components is significantly lower than that of MIM components which have only been sintered (measurement points in the form of circles), i.e. creep resistance is significantly increased by the heat treatment. Here, the improvement in the creep properties is particularly pronounced at relatively high temperatures and a relatively low mechanical stress level.

The average grain sizes represented here are given by way of example for the embodiments. In principle, embodiments allow the production of components, not only MIM components, that are creep-resistant and have comparatively large average grain sizes. Thus, in a proportion of the surface area of at least 20% there are average grain sizes of more than 200 μm.

The invention claimed is:

1. A method for the thermal treatment of a metal powder injection molded component (MIM component) in an injection molding process, comprising:

providing an MIM component including a nickel base alloy, sintering the MIM component at a sintering temperature, wherein, immediately after sintering, while in the injection molding process, directly proceeding from the sintering temperature to at least one treatment temperature below the sintering temperature, without any intermediate cooling below the at least one treatment temperature, and then heat treating the MIM component for a predetermined holding time at the at least one treatment temperature, wherein a difference between the sintering temperature and the at least one treatment temperature is less than 60° C., wherein the holding time of the at least one treatment temperature is between 0.5 hours and 50 hours.

2. The method according to claim 1, wherein the difference between the sintering temperature and the at least one treatment temperature is less than 50° C.

3. The method according to claim 1, wherein the holding time of the treatment temperature is between 5 and 35 hours.

4. The method according to claim 1, wherein the MIM component is held for 10 to 20 hours at 1260° C., for 2 to 6 hours at 1080° C. and for 15 to 25 hours at 870° C.

5. The method according to claim 1, wherein the nickel base alloy is a CM247LC alloy or a modified CM247LC alloy.

6. The method according to claim 5, wherein the modified CM247LC alloy contains proportions of elements within the following limits:

| | | Alloy (% by weight) | | | | | | | | | | | |
|---|---|---|---|---|---|---|---|---|---|---|---|---|---|
| | | Ni | Cr | Co | Mo | Al | Ti | Ta | W | C | B | Zr | Hf |
| Mod. CM247LC alloy | Min | Bal. | 7.5 | 9.0 | 0.4 | 5.4 | 0.0 | 0.0 | 9.3 | 0 | 0 | 0 | 0 |
| | Max | Bal. | 8.5 | 9.5 | 0.6 | 5.7 | 0.6 | 3.1 | 9.7 | 0.07 | 0.01 | 0.007 | 1.4 |

7. The method according to claim 5, wherein the modified CM247LC alloy contains a total of more than 1.5% by weight of carbide formers C, Hf, Ti, Ta, B, Nb and/or Zr and/or boride formers W, Co and/or Cr.

8. The method according to claim 5, wherein the modified CM247LC alloy has a carbon content of less than 0.05% by weight and a hafnium content of less than 1.4% by weight.

9. The method claim 5, wherein the modified CM247LC alloy has a carbon content of less than 0.06% by weight and a hafnium content of less than 1.4% by weight.

10. The method according to claim 5, wherein the at least one treatment temperature is between 1240 and 1290° C.

11. The method according to claim 1, wherein the difference between the sintering temperature and the at least one treatment temperature is in a range of 20 to 40° C.

12. The method according to claim 1, wherein the MIM component is held for 15 hours at 1260° C., for 4 hours at 1080° C. and for 20 hours at 870° C.

13. The method according to claim 5, wherein the modified CM247LC alloy has a carbon content of less than 0.04% by weight, and a hafnium content of less than 1% by weight.

14. The method claim 5, wherein the modified CM247LC alloy has a carbon content of less than 0.05% by weight, and a hafnium content of less than 1% by weight.

15. The method according to claim 5, wherein the at least one treatment temperature is between 1250 and 1285° C.

16. The method according to claim 5, wherein the modified CM247LC alloy has a carbon content of less than 0.03% by weight, and a hafnium content of less than 0.5% by weight.

17. The method claim 5, wherein the modified CM247LC alloy has a carbon content of less than 0.05% by weight, and a hafnium content of less than 0.5% by weight.

18. The method according to claim 5, wherein the at least one treatment temperature is 1260° C.

* * * * *